US006068740A

United States Patent [19]

Prandoni

[11] Patent Number: 6,068,740

[45] Date of Patent: May 30, 2000

[54] SYSTEM FOR ADJUSTING ANODE-CATHODE SPACING IN A MERCURY-CATHODE ELECTROLYTIC CELL

[75] Inventor: Roberto Prandoni, Legnano, Italy

[73] Assignee: PRS Di Ing. Roberto Prandoni & C.S.a.s., Milan, Italy

[21] Appl. No.: 09/207,602

[22] Filed: Dec. 9, 1998

[51] Int. Cl.[7] ..... C25D 17/00

[52] U.S. Cl. ..... 204/221

[58] Field of Search ..... 204/221, 219, 204/225

[56] References Cited

U.S. PATENT DOCUMENTS 3,616,448 10/1971 Rossi et al. ..... 204/297

*Primary Examiner*—Kathryn Gorgos
*Assistant Examiner*—Thomas H Parsons
*Attorney, Agent, or Firm*—Nixon & Vanderhye, P.C.

[57] ABSTRACT

An electrode carrying frame drive system for mercury-cathode electrolytic cells. The drive system is made up of a plurality of electrode carrying frames (20) each of which is associated with two crosspieces (12) each with two inclined surfaces (13) on which two carriages (21) slide driven by at least one motorization (30) causing raising and lowering of the electrode frame.

10 Claims, 7 Drawing Sheets

SYSTEM FOR ADJUSTING ANODE-CATHODE SPACING IN A MERCURY-CATHODE ELECTROLYTIC CELL

BACKGROUND OF THE INVENTION

Field of the Invention

The present invention relates to a system for regulating anode-cathode spacing in a mercury-cathode electrolytic cell.

Production of chlorine and soda is obtained through the electrolysis of a saturated sodium chloride solution.

There are various types of electrolytic cells, amongst which the mercury-amalgam cathode cell is of great importance.

The cell (FIG. 1) consists of an iron tank on the bottom of which the mercury that forms the cathode surface flows. The anode surface is made up of a plurality of activated titanium electrodes (called D.S.D.) supported by frames that are moved manually or by microprocessor-controlled drive systems.

The electrical current is carried to the anode and the cathode by means of copper bars connected to an electrical power supply.

The above mentioned electrolytic cell, called a primary cell, is supplied with saturated sodium chloride brine which, when the current is passed, is decomposed and develops gaseous $Cl_2$ at the anode, forming an amalgam of sodium and mercury at the cathode.

The sodium amalgam leaves the primary cell and enters a secondary cell, called a decomposer, filled with graphite and supplied with water.

On contact with graphite the amalgam reacts with the water and forms hydrogen, soda and mercury. The latter is returned to the primary cell by a pump.

A characteristic of the process in the primary electrolytic cell is that the cathode made up of mercury flowing on the bottom of the cell can vary in thickness both because of problems with the recirculating pump and particularly because of the scale that is deposited on the bottom of the cell due to the impurities contained in the brine. The thickness of the mercury can therefore vary from 1 to 20 mm depending upon process conditions.

In order to reduce power consumption (which is proportional to the anode-cathode distance) to a minimum, the anode-cathode distance must be kept between 1 and 3 mm, and in these operating conditions it becomes likely that short circuits will occur between the anode and the cathode, destroying the electrodes and generating explosive situations inside the cell.

For these reasons, the electrodes are supported by mobile frames controlled by microprocessors in order to maintain the anode-cathode distance constant.

For high performance to be achieved it is therefore of fundamental importance for the anode supporting system (frames) and particularly the drive system thereof to be precise in order to maintain the anode-cathode distance as constant as possible as the thickness of the mercury varies.

Various systems for adjusting the anode-cathode distance have been proposed, none of them without drawbacks.

One method consists of using four mechanical jacks disposed at the comers of the corresponding frame, driven two by two by geared motors. This system is very good as far as operating precision is concerned, but it can be used only for cells with few frames, that is of a large size, and it is very expensive.

Another method is a leverage system: to operate it needs strong levers with ovalized holes, thus with mechanical clearance that must be taken up, especially when inverting the direction of adjustment. The main defect is due to the fact that as the levers change in length during operation they introduce vertical movements of the leverage that are not proportional to the vertical movement of the frames. The control system is therefore not proportional to the actual distance between the electrodes, therefore computerized control is not possible.

Another system has pulleys with sprocket wheel drive chains: it introduces considerable clearance as the chains wear. Furthermore, this system does not afford the possibility of adjusting the anode-cathode planes, and therefore lacks precision.

Yet another system is with a torsion bar: a shaft that rotates with an angular movement mounted beneath the electrode frame. Adjustment is uncertain and imprecise especially because of the speed of raising, which, for successful adjustment, is required to be about 0.3–0.6 mm/sec with a precision of 1/10mm. It has the same defect as the leverage.

BRIEF SUMMARY OF THE INVENTION

The object of the invention is to replace the above described adjustment systems, providing a new system able to operate with automatic drive and control systems (microprocessors).

Another object of the invention is that of providing a system for adjusting the spacing between the electrodes of an electrolytic cell that is of simple, reliable and inexpensive construction.

These objects are achieved, according to the invention, as specified in appended independent claim 1.

Preferred embodiments of the invention are described in the dependent claims.

Substantially, the new electrode frame drive system consists of mobile supports resting on inclined surfaces. The movement of the mobile supports is ensured by a shaft having threaded ends in opposition and driven by a geared motor.

Further characteristics of the invention will be made clearer by the detailed description that follows, referring to purely exemplary and therefore non-limiting embodiments thereof, illustrated in the appended drawings, in which:

DETAILED DESCRIPTION OF THE DRAWINGS

Figure 2:
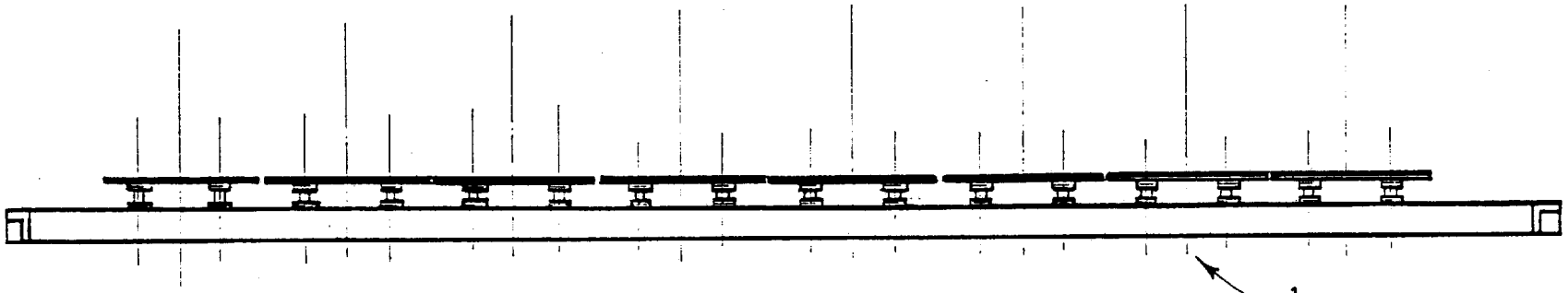
FIG. 2 is a side view of the cell in FIG. 1.
Figure 1:
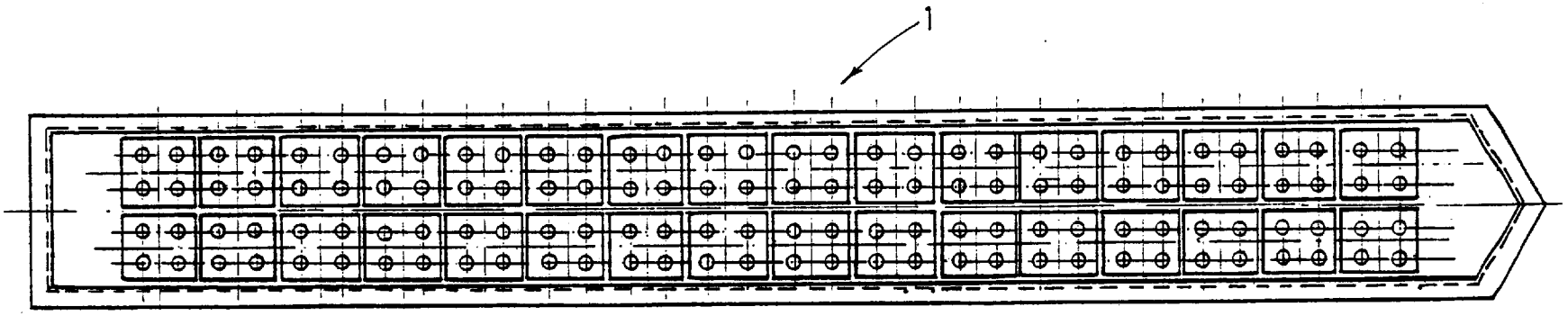
FIG. 1 is a diagrammatic plan view of an electrolytic cell comprising a plurality of titanium electrodes, disposed in groups of 4 and forming two parallel rows.

In FIGS. 1 and 2, an electrolytic cell, indicated as a whole by reference numeral 1, is shown diagrammatically, in a plan view and a side view, respectively, and comprises, in the case in point, two longitudinal rows of 16 groups of four electrodes each. Obviously the illustration is purely exemplary in that the cell 1 can be of any size, with a different number and arrangement of electrodes from that shown.

Figure 4:
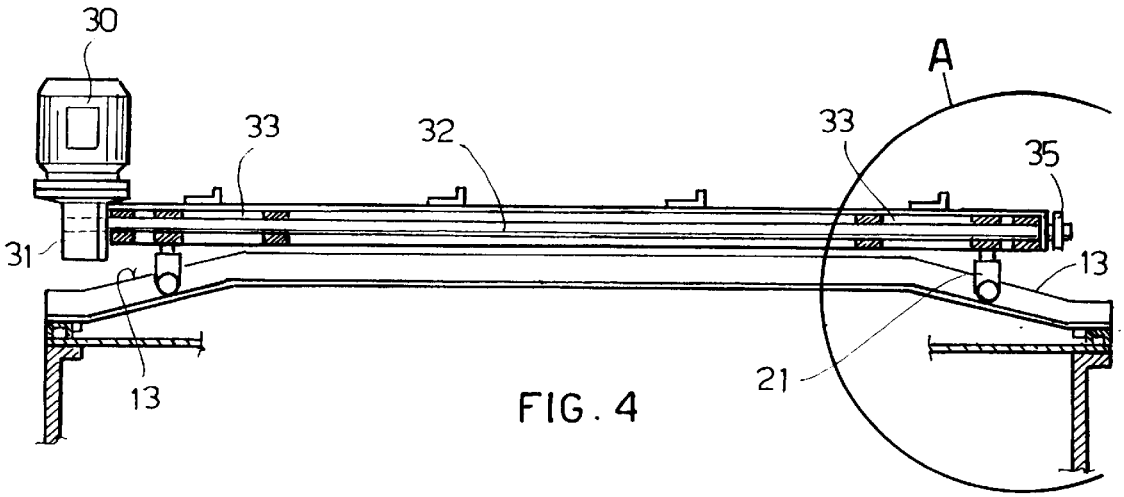
FIG. 4 is a diagrammatic section taken along the line IV—IV in FIG. 3.
Figure 5:
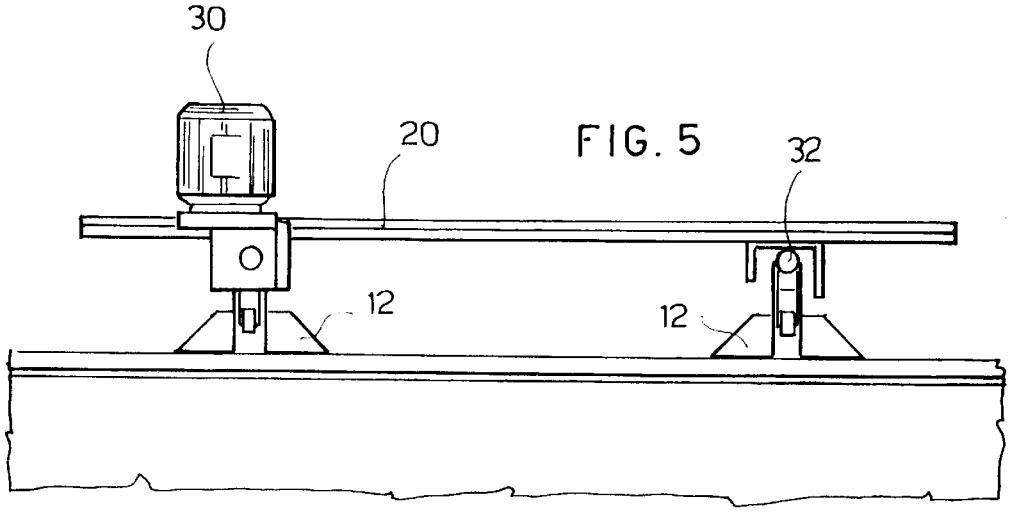
FIG. 5 is a side view taken in the direction of the arrow F in FIG. 3.
Figure 4A:
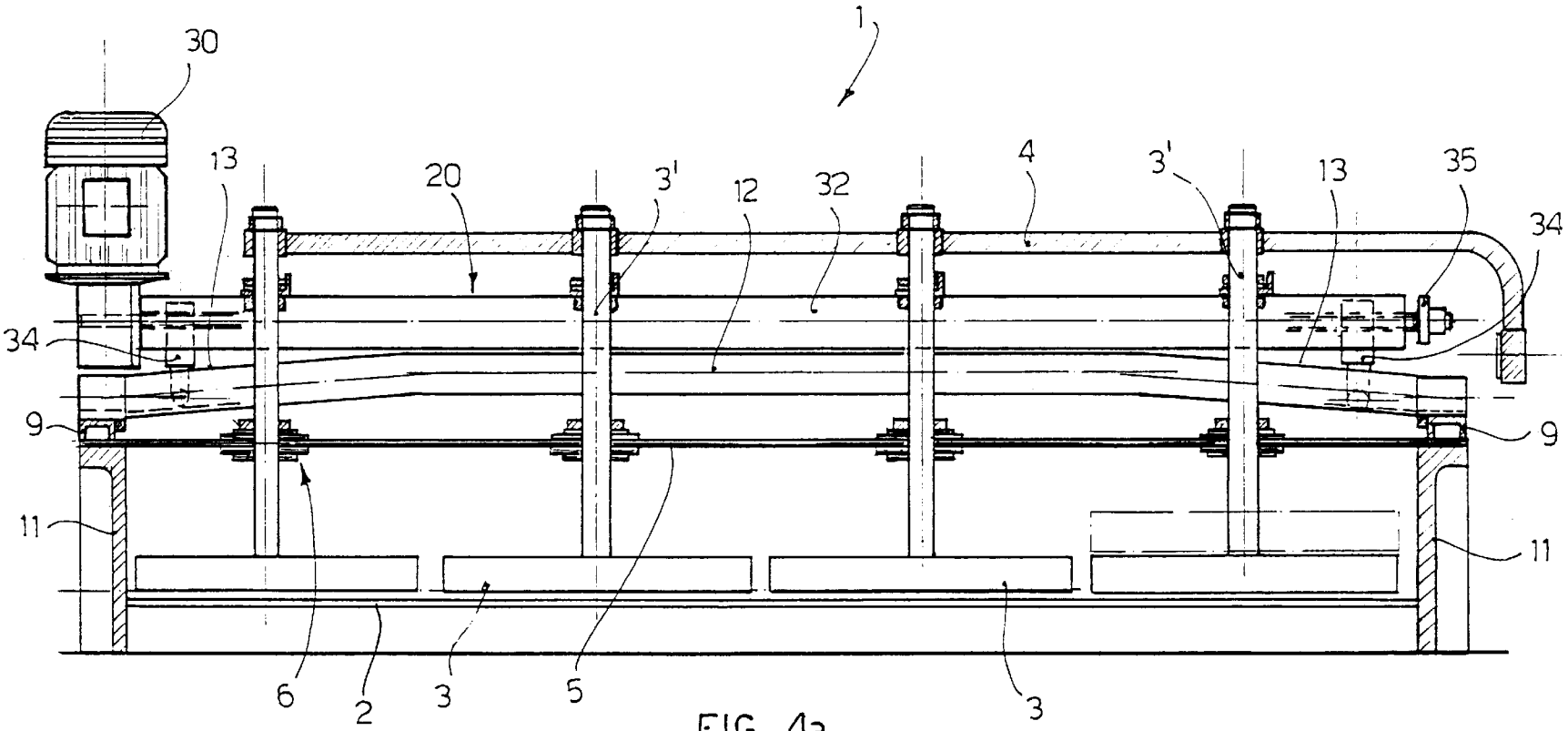
FIG. 4*a* is an enlarged view of FIG. 4 showing greater detail.

With reference for a moment to FIG. 4*a*, it can be seen that the cell 1 has a mercury cathode 2 disposed on the bottom of the cell and a plurality of titanium anodes 3, flattened in shape, disposed a short distance from the surface of the mercury cathode 2.

The anodes 3 are supported by respective pins 3', which for simplicity's sake will be identified henceforth with the electrodes 3. The pins 3' of the transverse row of electrodes shown in FIG. 4*a* are connected to each other by a copper bar, or flexible shaft, 4, on which the voltage drop between the two points thereof is measured, as stated previously, in order to carry out adjustment of the distance between electrodes 2 and 3.

The cell 1 is closed at the top by a belt 5 through which pass the supporting pins 3' of the electrodes 3, around which seals 6 are disposed.

The belt 5 rests on the side walls 11 of the cell and is kept fixed by a profile iron 9.

According to the embodiment shown in FIGS. 3 to 7, for each adjustment unit, two crosspieces 12, each provided with two inclined surfaces 13, symmetrical with respect to the midline, serving the purposes that will be stated below, are fixed on the side walls 11, above the profile irons 9.

A certain number of anode electrodes (16 in the example shown) are connected to each other by a single grid frame 20 (see in particular the plan view in FIG. 3), carried by four carriages 21, and able to slide on said inclined surfaces 13 of the crosspieces 12.

A motor 30 with a reduction unit 31, mounted integral thereto, which drives a shaft 32, having respectively right-handed and left-handed threads 33 at its ends, which screw into corresponding nut screws 34, supporting said carriages 21 is provided to drive the frame 20. In this way, the nut screws 34 and therefore the carriages 21 move in opposition.

Figure 3:
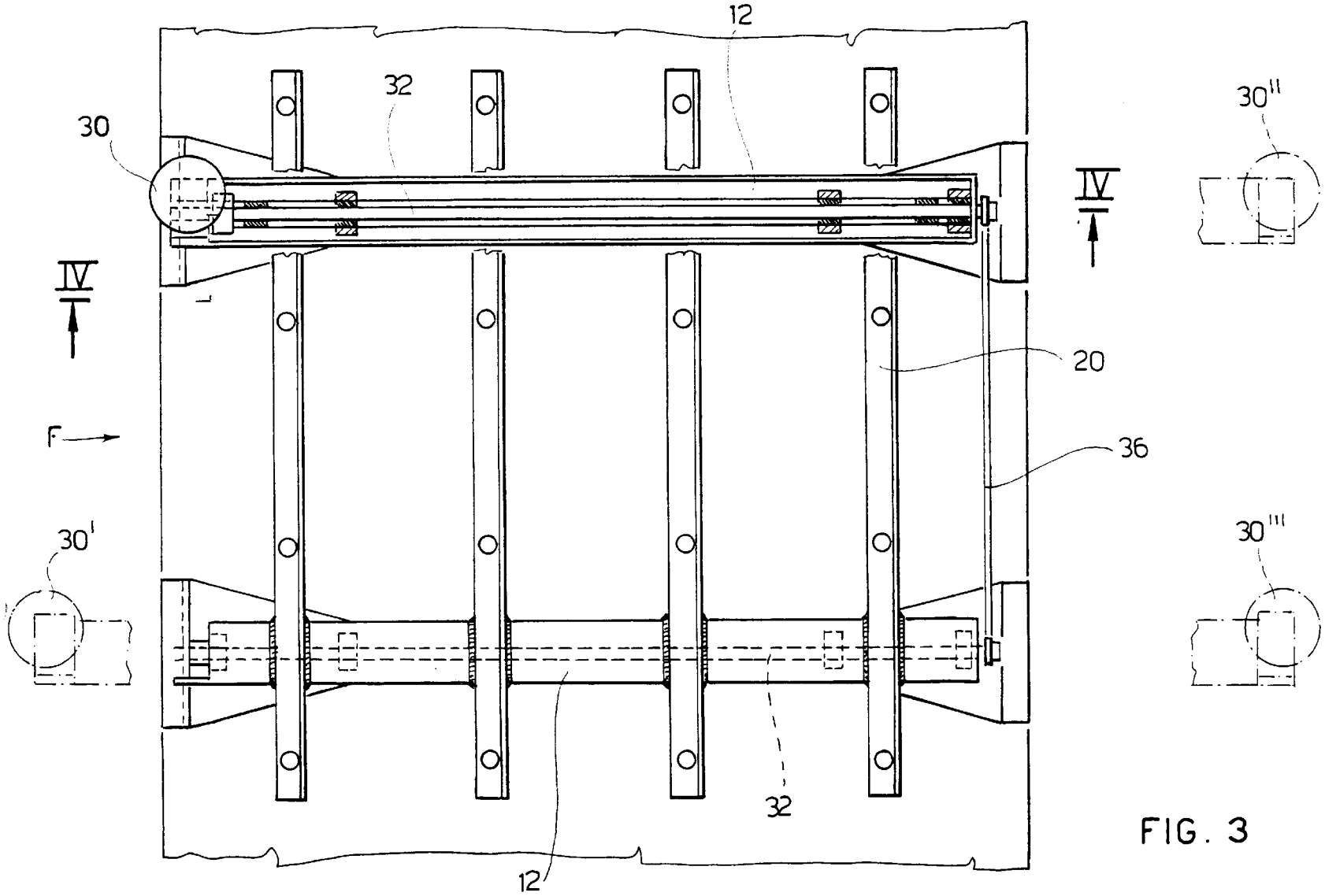
FIG. 3 is a plan view of a portion of the electrolytic cell, provided with a system for adjusting the distance between the electrodes according to a first embodiment of the invention.

With reference in particular to FIGS. 3 and 4, a sprocket wheel 35 is mounted at the end of the shaft 33, opposite that driven by the motor 30, said sprocket wheel transmitting movement through the chain 36 (see in particular FIG. 3) to another shaft 32, identical to the one described before, positioned above the other crosspiece 12.

In this way, operation of the motor 30 in one direction or the other will cause raising or lowering of the frame 20 parallel to itself, through sliding of the carriages 21 on the inclined surfaces 13 of the crosspieces 12.

In FIG. 3 other motors 30 that could be installed on the frame 20 to allow other possibilities of movement thereof are shown hatched.

Thus, for example, by replacing the chain transmission 36 with a second motor 30' driving the second threaded shaft 32, the frame 20, besides being moved vertically and parallel to itself, can be made to tip in the lengthwise direction of the cell, for example north-south.

According to a further embodiment, cutting the threaded shafts 32 in the middle, another two motors 30", 30'" can be provided to drive the four ends of the shafts 32 separately, thus making the four supports or carriages 21 of the frame 20 independent and allowing the frame be able to tip in the crosswise direction also, for example east-west.

The possibility of making the electrode supporting frame able to tip renders the adjustment system even more efficient, though more costly. Thus, adoption of the tipping system in one or both directions will be determined by economic convenience, that is, by the cost per kWh in the various countries of the world.

Figure 6A:
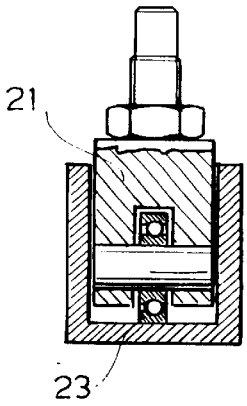
FIG. 6*a* is a section taken along the plane VI—VI in FIG. 6.
Figure 6:
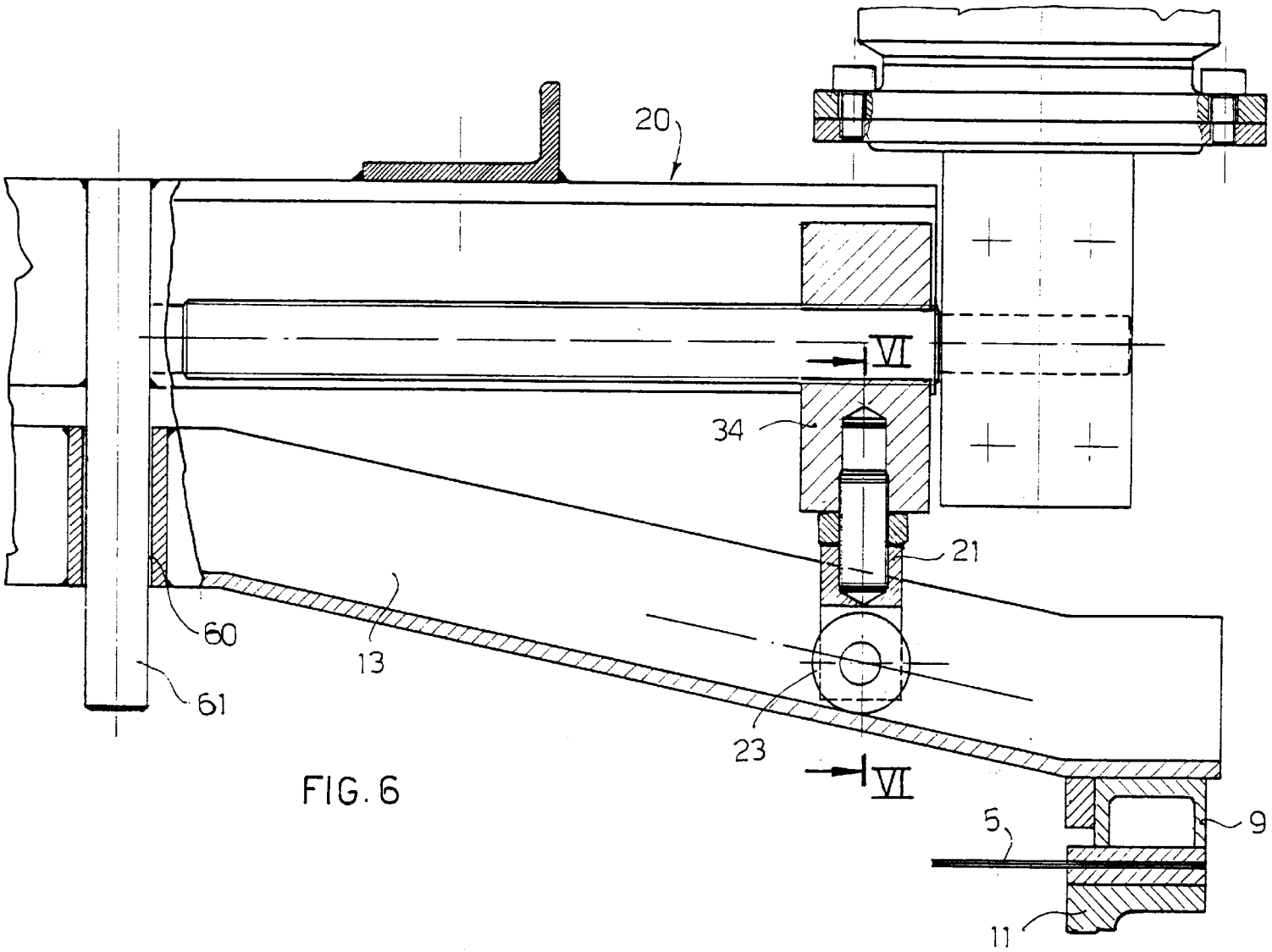
FIG. 6 is an enlargement of the detail indicated by A in FIG. 4.

FIG. 6 illustrates a supporting carriage 21 for the frame 20 in detail. According to said embodiment, the carriage 21 rests simply, by means of a bearing 23, on the inclined surface 13 of the crosspiece 12, which is U-shaped in section, as can be seen in FIG. 6*a*.

Figure 7:
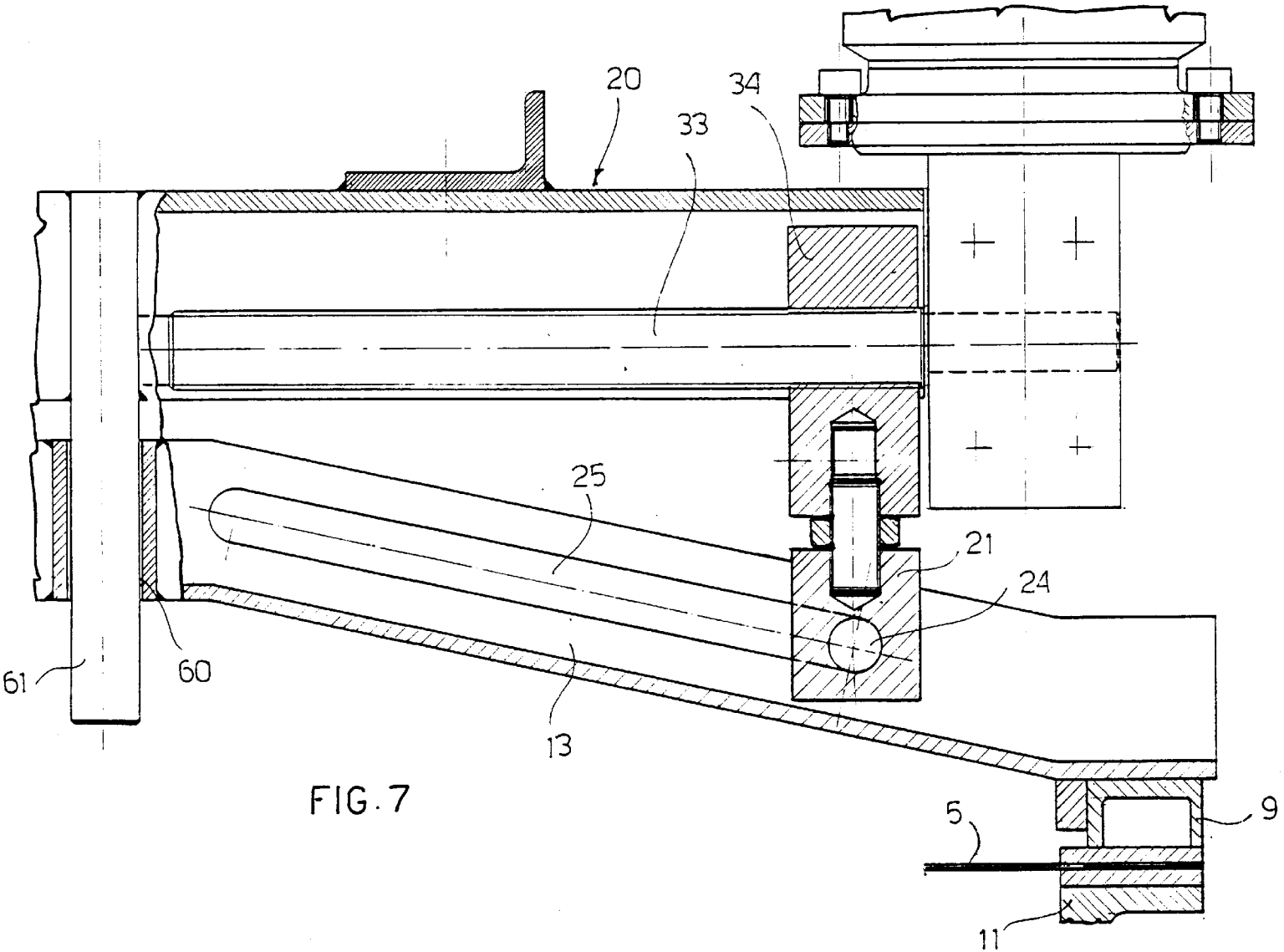
FIG. 7 is a similar view to FIG. 6, showing a different embodiment of sliding of the carriage on the inclined surface.

FIG. 7 illustrates another embodiment, which differs from that in FIG. 6 only in that provided on the carriage 21 is a pivot 24 that slides in corresponding slots 25 made in the vertical walls of the inclined surface 13.

This second embodiment prevents the frame from moving away in the event of overpressure inside the cell.

The embodiments described thus far, as has been seen, provide for crosspieces 12 with inclined surfaces 13 fixed to the side walls 11 of the cell and the electrode carrying frame 20 mobile together with its motorizations, for controlled raising and lowering of the electrodes 3 and the flexible shafts 4.

The adjustment system according to the invention can be inverted, that is, it can have the crosspieces with inclined surfaces integral with the electrode carrying frame, and therefore mobile therewith, and the motorizations fixed.

Figure 8:
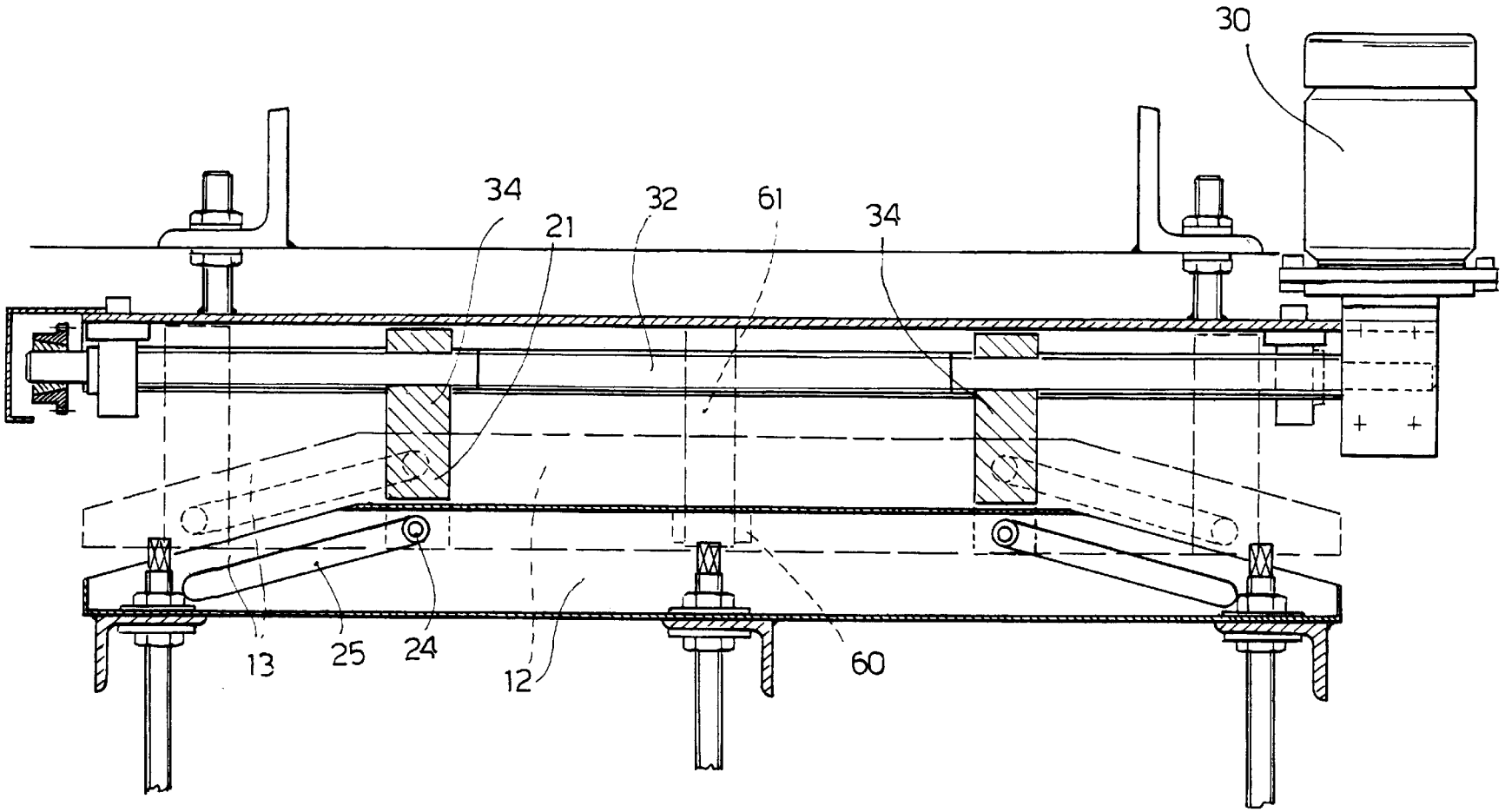
FIG. 8 is a diagrammatic cross section, showing an embodiment of the drive means of the anode bearing frames reversed with respect to that in the previous figures.

Such a variant embodiment is illustrated diagrammatically in FIG. 8.

As can be seen in said figure, the crosspiece 12, shown in two different positions in the figure, is integral with the electrode carrying frame 20, whilst the motor 30, and the threaded shaft 32, are mounted in a fixed position. The nut screws 34, supporting the carriages 21 which slide horizontally along the shaft 32, cause raising and lowering of the crosspieces 12, and thus of the electrode carrying frame 20 by means of the respective pins 24 that slide in hollows or slots 25 made in the inclined surfaces 13.

Operation is therefore perfectly analogous to that illustrated previously with reference to FIGS. 3 to 7.

The embodiment in FIG. 8 is particularly interesting for plants with pre-existing supports outside the electrolytic cell, on which simple iron sections are rested supporting the fixed part, that is, the motorizations of the electrode carrying frame 20.

In all the embodiments described, mechanical safety stops (not shown) are provided to prevent any movement of the frame beyond the minimum and maximum distances between the electrodes 2 and 3.

Likewise, to avoid slipping of the carriages 21 on the inclined surfaces 13, on each crosspiece 12 a slot 60 is provided in which a pin 61 integral with the structure bearing the motorization(s) 30, 30', 30", 30'" (see in particular FIGS. 6 and 7) fits with a certain clearance.

With the cost of power increasing in all countries of the world, in order to achieve efficiency in an electrolysis plant it is necessary to make the most fractional adjustments possible to the electrodes. This imposes use of increasingly small, efficient and low-cost electrode carrying frames, for which the solutions of the previously described prior art are poorly suited.

Although the simplicity and low cost of the adjustment system according to the invention make it suitable in particular for small frames, and therefore for a limited number of electrodes, it is obvious that it can be applied to frames of any size and with any number of electrodes.

What is claimed is:

1. A system for adjusting the anode-cathode spacing in an electrolytic cell for manufacturing chlorine and soda, comprising a liquid mercury electrode (2) disposed on the bottom of the cell (1) and a plurality of anode electrodes (3), supported in groups by a frame (20) that can be adjusted in height, characterized in that combined with each frame (20) are at least two crosspieces (12), each provided with a pair of inclined surfaces (13), for sliding of corresponding carriages (21), able to raise or lower said electrode carrying frame (20), at a command imparted by a control logic of the cell.

2. A system according to claim 1, characterized in that it provides at least one motorization (30) for movement of said carriages (21) sliding on said inclined surfaces (13).

3. A system according to claim 1, characterized in that said crosspieces (12) with inclined surfaces (13) are fixed to the cell (1), whilst the electrode carrying frame (20), with said at least one motorization (30) is moveable with respect to said crosspieces (12).

4. A system according to claim 1, characterized in that said crosspieces (12) with inclined surfaces (13) are integral with the electrode carrying frame (20), and moveable therewith, whilst said at least one motorization (30) is fixed with respect to the cell (1), and drives the frame (20)/crosspieces (12) assembly.

5. A system according to claim 1, characterized in that a single motor (30) is provided that sets in rotation a first shaft (32) with the ends (33) threaded in opposite directions, with which respective nut screws (34) bearing respective carriages (21) screw, said carriages moving in contraposition on said inclined surface (13) of one of the crosspieces (1), and the rotation of the shaft (32) being transmitted by chain or belt means (36) to a second shaft (32), functionally identical to the first, disposed at the other crosspiece (12).

6. A system according to claim 5, in which said chain or belt transmission (36) is replaced by a second motor (30') driving said second shaft (32) separately in order to make the electrode frame (20) tip in one direction.

7. A system according to claim 6, in which said shafts (32) are cut in the midline, and another two motors (30", 30'") are provided to drive the four ends of the two shafts (32) separately, thus obtaining separate movement of the two carriages (21), and the possibility of tipping the electrode frame (20) in two directions.

8. A system according to claim 1, characterized in that said carriages (21) slide guided by respective pins (24) in corresponding slots (25) in said inclined surfaces (13) of the crosspieces (12).

9. A system according to any one of the preceding claims, characterized in that on each crosspiece (12) a slot (60) is provided in which a pin (61) integral with the structure supporting the motorization(s) (30, 30', 30", 30'") is housed with a certain clearance, in order to avoid any slipping of the carriages (21) on the inclined surfaces (13).

10. An electrolytic cell for manufacture of chlorine and soda, comprising an anode-cathode spacing adjustment system according to any one of the preceding claims.

* * * * *